US006062040A

United States Patent [19]

Bostic et al.

[11] Patent Number: 6,062,040

[45] Date of Patent: May 16, 2000

[54] INSULATED CHEST AND METHOD

[75] Inventors: William M. Bostic; Stewart D. Glenn, both of Asheboro, N.C.

[73] Assignee: Vesture Corporation, Asheboro, N.C.

[21] Appl. No.: 09/298,883

[22] Filed: Apr. 26, 1999

Related U.S. Application Data

[63] Continuation of application No. 08/939,401, Sep. 29, 1997, Pat. No. 5,918,478, which is a continuation-in-part of application No. 08/705,753, Aug. 30, 1996, Pat. No. 5,865,037.

[51] Int. Cl.[7] ..... F25D 3/08

[52] U.S. Cl. ..... 62/530; 62/457.2

[58] Field of Search ..... 62/457.2, 530, 62/371; 116/216; 374/106, 162

[56] References Cited

U.S. PATENT DOCUMENTS

| | | | |
|---|---|---|---|
| 4,498,312 | 2/1985 | Schlosser | 62/457.2 |
| 4,753,188 | 6/1988 | Schmoegner | 116/217 |
| 5,103,651 | 4/1992 | Coelho et al. | 62/341 |
| 5,400,610 | 3/1995 | Macedo | 62/130 |
| 5,444,989 | 8/1995 | Gawron et al. | 62/129 |

*Primary Examiner*—Henry Bennett
*Assistant Examiner*—Melvin Jones

[57] ABSTRACT

A lightweight, insulated chest and method are provided for transportation and storage of perishable and other items which require a temperature-controlled environment. The chest includes insulated side walls, bottom and a hinged cover which is pneumatically sealed to prevent tampering and for thermal security. The chest includes a fluid conduit within the cover for air evacuation and depressurization of the interior and also includes a conduit to provide a vacuum between the walls of the sides and bottom which contain a rigid polymeric foam insulation.

7 Claims, 9 Drawing Sheets

INSULATED CHEST AND METHOD

This is a continuation of application Ser. No. 08/939,401 filed Sep. 29, 1997, now U.S. Pat. No. 5,918,478, which was a continuation-in-part of Ser. No. 08/705,753 filed Aug. 30, 1996 now U.S. Pat. No. 5,865,037.

BACKGROUND OF THE INVENTION

1. Field of the Invention

The invention herein pertains to an insulated storage chest and particularly to a chest used to store and transport perishable items such as certain foods, biological materials and the like.

2. Description of the Prior Art And Objectives of the Invention

Insulated storage chests have been used for many years to transport food and other items in a temperature-controlled environment. Such chests generally employ insulated walls between which a heating or cooling device is placed proximate the food items. Such chests are useful and reliable for relatively short periods of time (2–4 hours). However, if perishable items are to be kept longer at specific temperatures, then often the perishable items have to be removed and the heating or cooling devices replaced or re-energized at periodic intervals to maintain the interior of the chest at the desired temperature. Such exchanges of the heating or cooling devices are oftentimes difficult, if not impossible, especially if the chest is being transported, for example, in an airplane where access to the chest is not available. Also, in remote field locations, re-energizing or replacing of the heating or cooling device may not be practical.

Even in chests which utilize a vacuum to prevent temperature fluctuations, problems arise because most conventional plastic coolers are slightly porous or otherwise leak, thereby causing the chest to lose its vacuum over time. In steel or metal chests with walls of the necessary rigidity and non-porousness, the cooler becomes too cumbersome to be easily transportable. Rough use may also damage or weaken the chests and thereby cause the vacuum to fail at an inopportune time.

Thus, with the disadvantages and problems associated with prior art insulated chests, the present invention was conceived and one of its objectives is to provide a portable, relatively lightweight storage chest for perishable items which will maintain a controlled and desired temperature level in excess of twenty-four hours under normal ambient temperatures.

It is still another objective of the present invention to provide an insulated chest and method which will greatly facilitate the storage and transportation of foods, biological materials and other items which require temperature control.

It is yet another objective of the present invention to provide an insulated chest which is pneumatically sealed for thermal security.

It is a further objective of the present invention to provide an insulated chest which will prevent convective and conductive heat transfer both in and out of the chest.

It is still a further objective of the present invention to provide an insulated chest which incorporates a conduit within a hinged cover which can be connected to a vacuum pump for sealing the chest and evacuating air from within the chest's container.

It is also an objective of the present invention to provide a chest in which the side walls and bottom have both an insulating material therebetween and a vacuum to increase the insulation rating.

It is another objective of the present invention to provide an insulated chest which has a sealed chamber within the side walls for maintaining a vacuum therein.

It is still a further objective of the present invention to provide a means for sealing a chamber between the chest's container compartment and the exterior surfaces of the chest to effectively maintain vacuum pressure even after rough or heavy use and handling.

It is yet another objective of the present invention to provide a plastic chest with a vacuum chamber in the side walls which is sealed to prevent the loss of vacuum pressure.

It is a further objective of the present invention to provide an insulated chest which receives a set of thermal control elements in order to maintain a desired temperature for an extended period of time.

It is still a further objective of the present invention to provide a set of interlocking cooling elements within the insulated chest which can maintain sub-zero temperatures for extended periods of time.

It is yet another objective of the present invention to provide a cooling element which changes color upon freezing so that a user can easily tell if the cooling element is charged visually.

Various other objectives and advantages of the present invention will become apparent to those skilled in the art as a more detailed description is set forth below.

SUMMARY OF THE INVENTION

The aforesaid and other objectives are realized by the insulated chest and method for storing and transporting perishable or other items which require strict temperature control. The chest is formed from plastic whereby relatively thick sides, bottom and a cover contain a rigid, polymeric foam for insulation purposes. The side walls and bottom are evacuated at the factory by an electric vacuum pump to increase the insulative qualities. Prior to evacuation, a sealing means is placed within the side walls of the chest in order to prevent the side walls from losing the subsequent vacuum.

Items are placed in the container of the chest with charged heating or cooling elements as needed proximate the items. Cooling elements are charged, for example, by freezing them. These cooling elements are then placed inside the chest in an interlocking arrangement so that optimal cooling is accomplished. On the other hand, heating elements are charged through conventional means, for example, by microwave radiation or the like and then placed within the chest to help keep the items at the desired temperature. The hinged cover is then closed and a vacuum pump is attached to a valved conduit on the cover and a vacuum is drawn on the container wherein the items rest. This both seals the cover and improves the thermal security of the contents. Once a sufficient vacuum has been drawn a wrench is inserted into a channel to turn a ball valve to a closed position. The wrench is removed, the vacuum pump is disconnected and the sealed chest is ready for storage and transportation.

DETAILED DESCRIPTION OF THE PREFERRED EMBODIMENTS OF THE INVENTION AND ITS OPERATION

Figure 1:
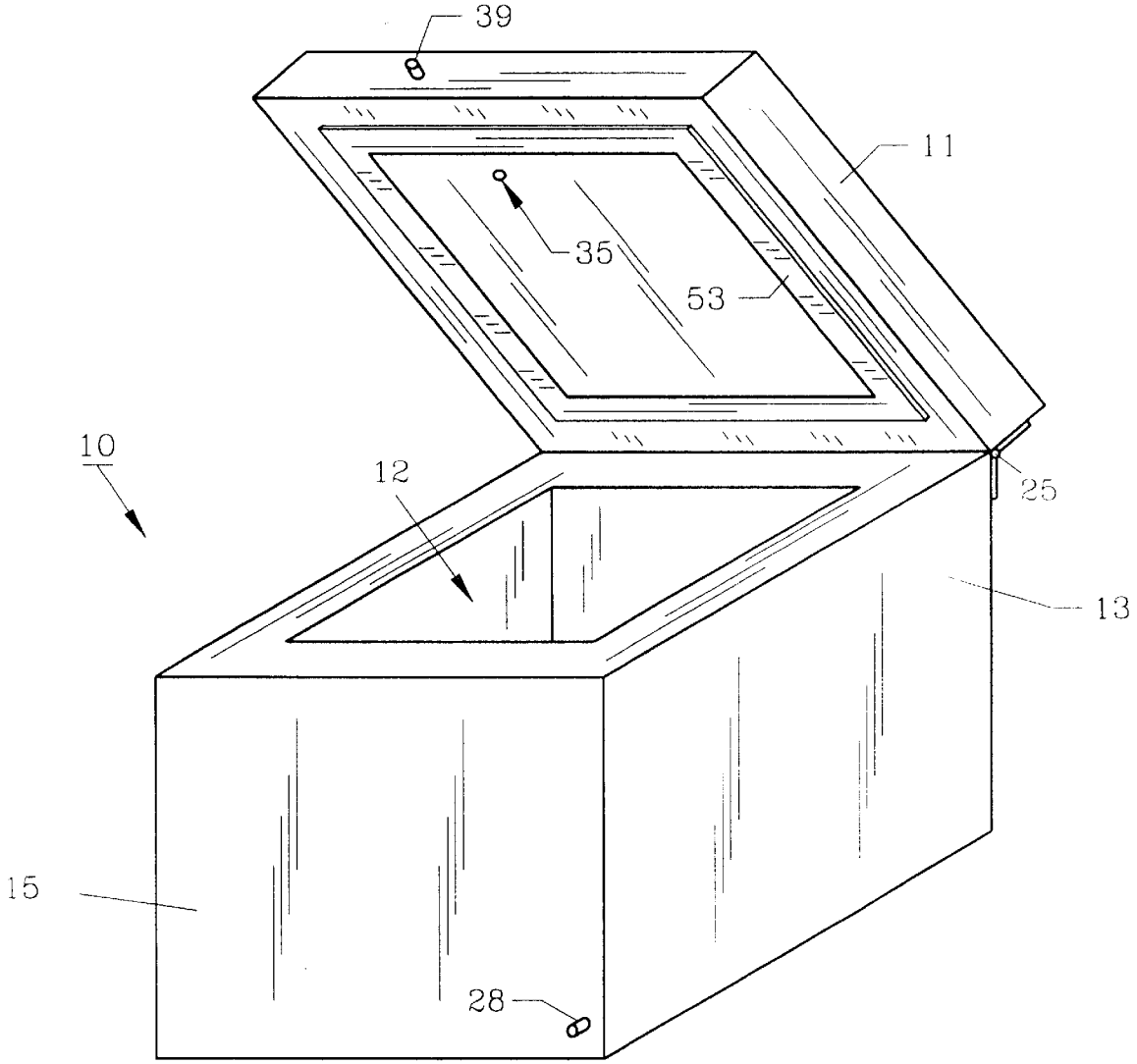
FIG. 1 demonstrates a perspective view of the of the storage chest of the invention with the cover raised.
Figure 2:
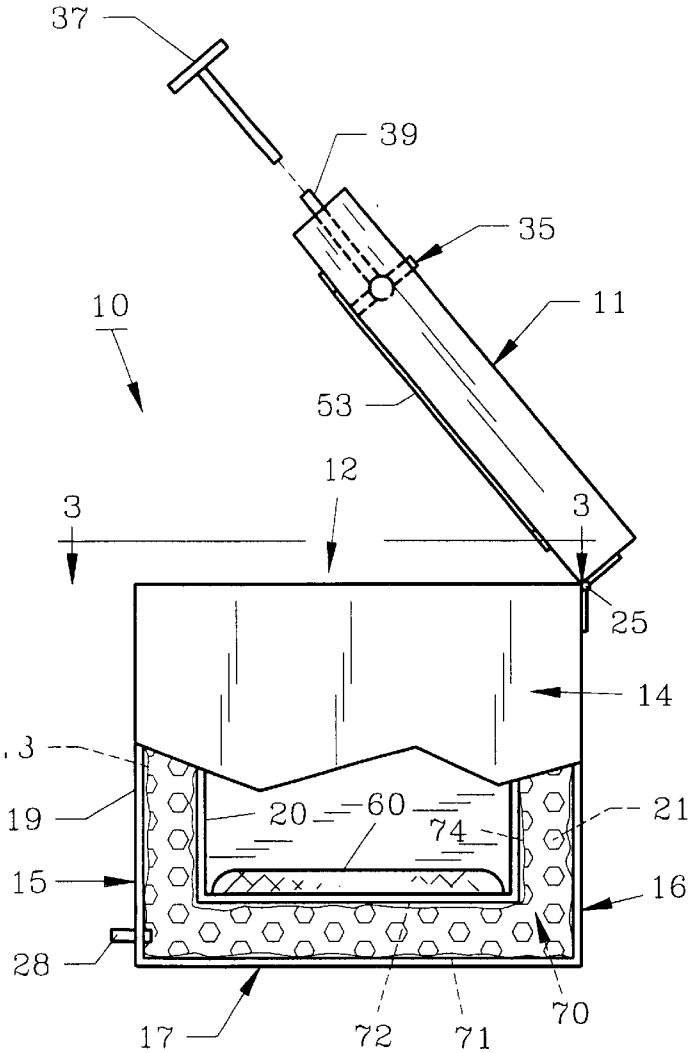
FIG. 2 illustrates a cutaway side view of the chest as shown in FIG. 1 to better show its construction.
Figure 3:
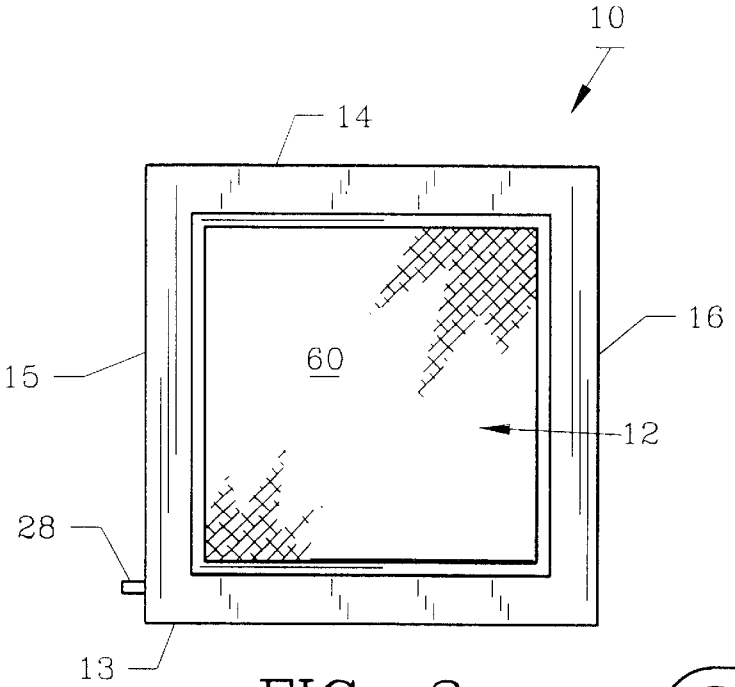
FIG. 3 features a top view of the chest along lines 3—3 of FIG. 2.

For a better understanding of the invention and its method of operation, turning now to the drawings, FIG. 1 shows insulated chest 10, opened for placement of food or other perishable materials therein. As seen, insulated chest 10 includes a hinged cover 11 and a container 12 formed by side walls 13, 14, front wall 15, rear wall 16 and bottom 17 (FIGS. 2 and 3). In effect, all side walls, cover and bottom perform the same function and can be rearranged to suit particular needs. For example, there could be only one side wall in a circular configuration, with a bottom and cover, or chest 10 could be turned on its side, and look much like a conventional dormitory refrigerator, where the cover is really an openable side wall, the side walls are now a top wall, two side walls and a bottom wall and the bottom is now a rear or last side wall. For convenience and clarity though, the invention will described be in terms of chest 10 as pictured in FIG. 1. Conduits 28 and 35 provide means for evacuating gases as will be explained in greater detail below. A piano-type hinge 25, allows cover 11 to be easily raised and lowered as needed, although it is understood that in a refrigerator style configuration the movement would be horizontal, not vertical. Conventional gasket 53 effectively seals container 12 when cover 11 is closed. Wrench channel 39 activates ball valve 36 in conduit 35 (FIG. 5) as will be explained below.

As seen in FIG. 2, walls 13 (not shown), 14, 15, 16, and bottom 17 are substantially hollow and have continuous chamber 70 disposed between outside wall 19 and inside wall 20. Chamber 70 is generally cup-shaped and surrounds interior container 12 of chest 10. In the preferred embodiment, during manufacture, chamber 70 is coated internally with a liquid elastomeric composition (not shown) for sealing such as neoprene, butyl rubber, or other natural or synthetic elastomers, although butyl rubber is preferred, by injecting the liquid elastomeric composition through conduit 28. Interior surfaces 71 and 72 of walls 19 and 20 within chamber 70 may be roughened (not shown) to facilitate the adhesion of the liquid composition to interior surfaces 71 and 72. Chamber 70 is then agitated in such a manner so as to completely coat the interior surface of chamber 70. Upon drying, the elastomeric composition forms a tight bond with plastic walls 19 and 20 and creates non-porous layers 73 and 74 on interior surfaces 71 and 72 of walls 19 and 20 which are air impermeable. Thus, this liquid elastomeric composition acts as a means to seal chamber 70.

After the elastomeric composition has completed drying, insulation 21 which is preferably a polyurethane open cell foam or similar appropriate material is inserted or blown into chamber 70, for example, through conduit 28. In the preferred embodiment, insulation 21 has a thickness of approximately 6 cm between inside wall 20 and outside wall 19 which in turn are made of ABS plastic approximately 0.5 cm thick for a total wall thickness of approximately 7 cm (FIG. 2). The same construction is used on all four sides, bottom 17 and cover 11 of chest 10. Since cover 11 is not continuous with chamber 70, separate sealing and insulation steps must be taken for cover 11, but in the preferred method these steps are identical to the sealing and insulation steps used to insulate chamber 70.

Figure 6:
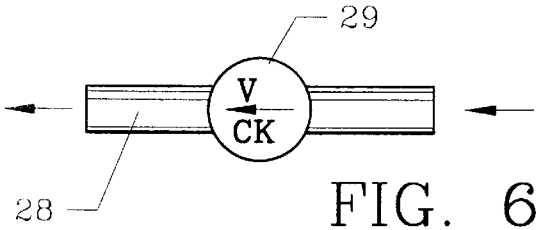
FIG. 6 depicts the conduit and check valve from the sidewall of the chest, also removed from the chest.

During manufacture, to increase the insulative properties of container 12, conduit 28, positioned through wall 19 into insulation 21 can be used as a means to evacuate gas, such as air, from within chamber 70. Insulation 21 has the structural integrity to withstand compressive forces when a vacuum is drawn through conduit 28. Conduit 28 includes check valve 29, shown schematically in FIG. 6, which allows pump 30 (FIG. 4) to apply vacuum pressure thereto. Once pump 30 has drawn a sufficient vacuum of approximately 75–100 mm of mercury (Hg), pump 30 is disconnected and check valve 29 prevents further air flow. This is part of the manufacturing procedure and is not required by the user. It is to be understood that the vacuum is not applied to the chamber within the side walls until after the sealing means and insulation 21 have been inserted and had time to set up, because outside wall 19 and inside wall 20 may buckle without the added rigidity of insulation 21. While it is possible to increase the strength of outside wall 19 and inside wall 20 by increasing the thickness of the ABS plastic used to construct said walls, such is not preferred, because in order to provide the strength needed to withstand the vacuum pressure, the additional thickness seriously impacts the lightweight and portable nature of chest 10. Likewise, steel or other metal walls could be used, but are not desired because of weight and other reasons.

It is within the scope of the present invention to have a separate chamber for each side wall, cover, and bottom wherein each wall is separately coated with a sealing composition and then filled with an insulating material as described above. While such is contemplated, it is not preferred because extra conduits would be required for each chamber so created thereby raising manufacturing costs.

Chest 10, as shown in FIG. 2, also includes another conduit 35 which passes through cover 11, and has associated therewith ball valve 36. Conduit 35 is shown removed from cover 11 in FIG. 5. Ball valve 36 can be easily turned manually by the use of wrench 37 which is inserted through perpendicular channel 39 of ball valve 36. Channel 39 is attached to ball valve 36 as shown.

Figure 4:
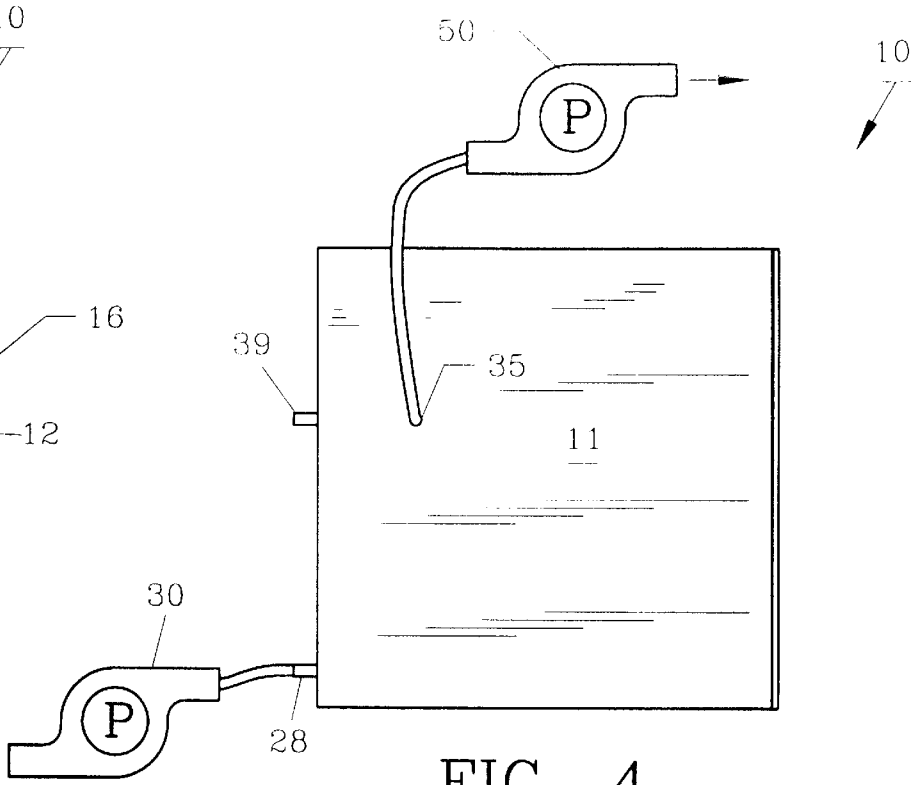
FIG. 4 presents a top view of the chest as seen in FIG. 1 with vacuum pumps attached to illustrate the evacuation processes.
Figure 5:
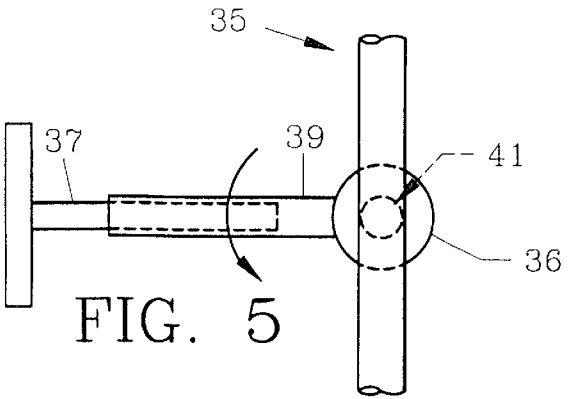
FIG. 5 pictures the conduit and associated ball valve from the cover of the chest in enlarged fashion with the wrench inserted into the channel.

As indicated in FIG. 5, with wrench 37 positioned in channel 39 of ball valve 36, opening 41 can be rotated from a horizontal position as shown in FIG. 5, to a vertical position, into alignment with conduit 35 to allow fluid passage therethrough. With opening 41 so aligned, vacuum pump 50, as shown in FIG. 4, can then be used to evacuate container 12 through gas evacuation means or conduit 35.

Figure 7:
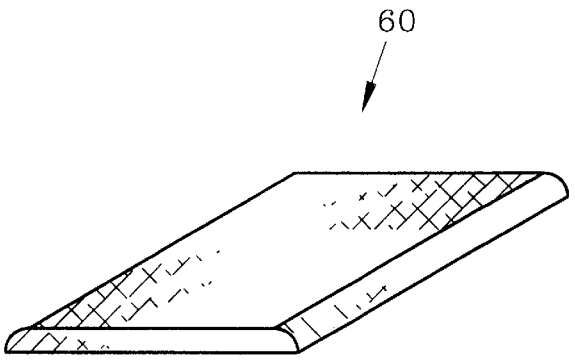
FIG. 7 shows a conventional heating or cooling element.

The preferred method of preparing chest 10 for use consists of selecting a conventional thermal element, such as thermal device 60 (FIG. 7) which is sized to fit along the floor of container 12 as shown in FIG. 2. Thermal device 60 is properly charged (heated or cooled) as desired. Thermal device 60 can be any of the conventional heating and cooling devices as are standard in the marketplace, but the preferred cooling element is seen in FIGS. 10–13.

Figure 10:
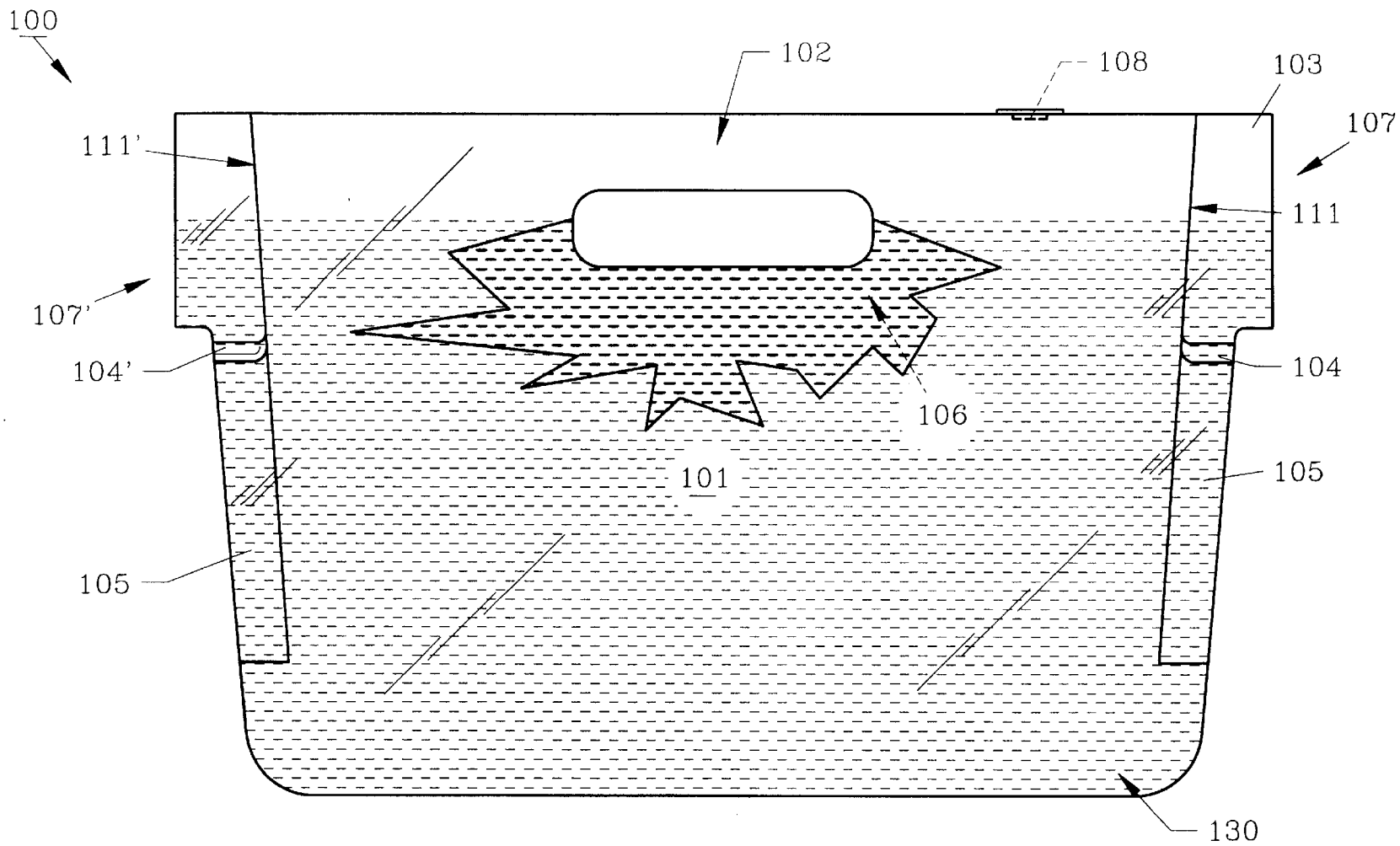
FIG. 10 depicts an individual cooling element.

Turning to FIG. 10, cooling element 100 is seen with front surface 101 and handle 102 for easy manipulation of cooling element 100. Cooling element 100 preferably has substantially transparent housing 130 for reasons that will become clear below. Cooling element 100 has wings 107 and 107' comprised respectively of main portions 103, 103', shoulders 104, 104', sloped surfaces 105, 105' and interior shoulders 111, 111', better seen in the side view of FIG. 11. Cooling element 100 is filled with a thermal mass, namely liquid 106, which is preferably a salt water solution. In the preferred embodiment, the salt water solution is 24% sodium chloride (NaCl) and 76% water ($H_2O$) by weight with a color change indicator (not shown in the black and white drawings) which changes color when liquid 106 is frozen. In this manner, users can easily tell if cooling element 100 has been charged (completely frozen), thus the need for transparent housing 130 for cooling element 100. The preferred color indicator is conventional green food color sold under the name FD&C Blue #1 (Sky Blue) sold by Country Kitchen of Fort Wayne Ind. 46808, which turns white upon freezing, but other color indicators could be used so long as a user could easily tell if cooling element 100 has been charged by mere visual inspection.

Figure 11:
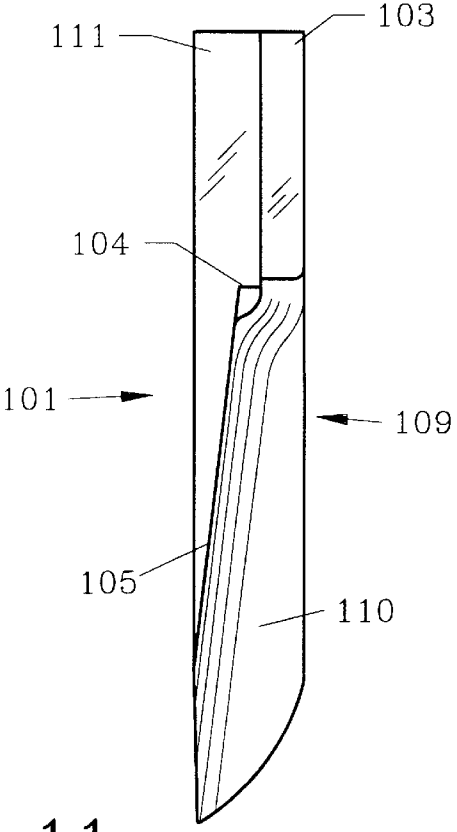
FIG. 11 demonstrates a side view of the individual cooling element of FIG. 10.
Figure 12:
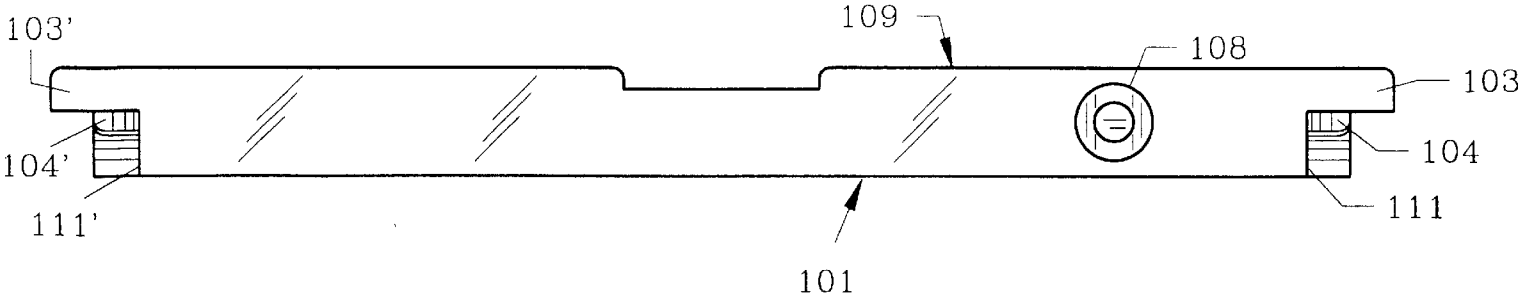
FIG. 12 presents a top view of the cooling element of FIG. 10.

Cooling element 100 seen in FIG. 11 shows back surface 109 which has smooth arcuate section 110 (only one shown, the other end of cooling element 100 having identical arcuate section 110'). FIGS. 10 and 12 show plug 108 which can be removed to fill, empty or refill cooling element 100 with liquid 106. In this manner liquid 106 can be changed in order to provide cooling elements with different freezing points. For example, if a biological specimen was being flown across country and it was critical to keep said specimen at −5° C., liquid 106's composition could be adjusted to provide a melting point of around −5° C., thereby insuring that the temperature would remain at about −5° C. as desired. If ice cream were transported in chest 10, and the only concern was keeping the ice cream cold as long as possible, the preferred 24% NaCl solution could be substituted which has a melting point around −20° C. or −5° F. Freezing points of various liquids are well known, and those skilled in the art may select a liquid with a desired freezing point and non-toxicity to meet the needs of a particular use.

Figure 13:
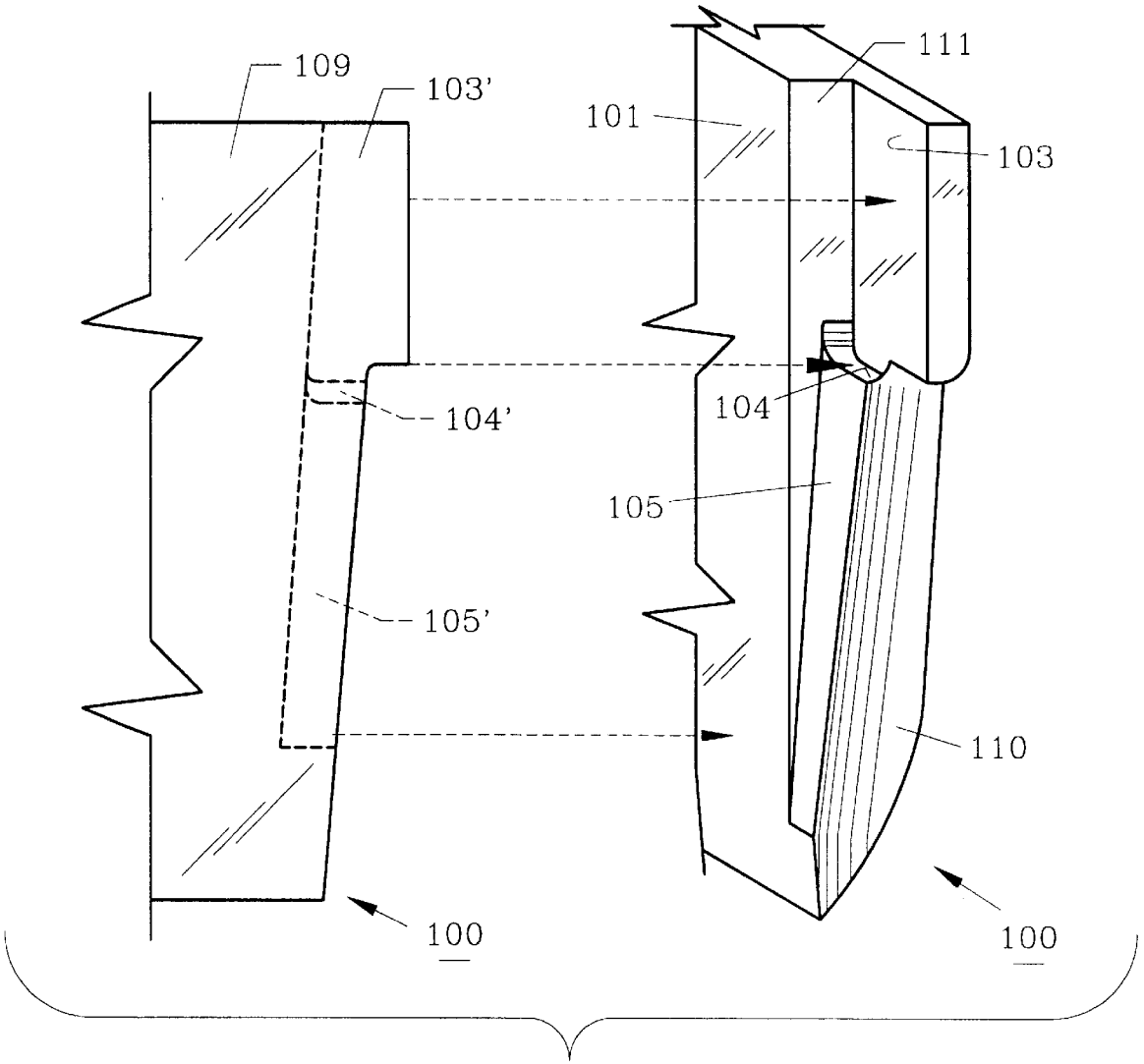
FIG. 13 pictures a partial view of a pair of cooling elements in an interlocked arrangement.

FIG. 13 shows an exploded view of the novel nature of cooling element 100 in that wings 107, 107' interlock and maintain cooling elements in a desired configuration within chest 10. Specifically, main portion 103 rests against interior shoulder 111', while shoulder 104' provides vertical support for main portion 103. Interior shoulder 111 and sloped surface 105 provide support for opposed interior shoulder 111' and sloped surface 105'. As better seen in FIG. 14, this interlocking arrangement works best when placed within preferred chest 140 to provide lateral support for cooling elements 100. While not shown in the drawings, it should be noted that cooling elements 100 can be rearranged within container 12 of chest 10 or container 145 of chest 140 to provide different compartments. For example, slots (not shown) could be provided in the middle of cooling element 100 so that wings 107 or 107' would slide into said slots much as wings 107, 107 fit together so that container 12 is divided in two. This arrangement can serve a bifurcated function in that cooling elements with different freezing points can be placed in container 12 thereby providing a frozen section and a merely refrigerated section. Likewise, an additional cooling element 120 can be placed on the interior surface 117 of cover 143 as seen in FIG. 15 by passing key-shaped holes 121, 121' over knobs 118, 118' and sliding restraining flange 119 into position to hold cooling element 120 in place.

Figure 14:
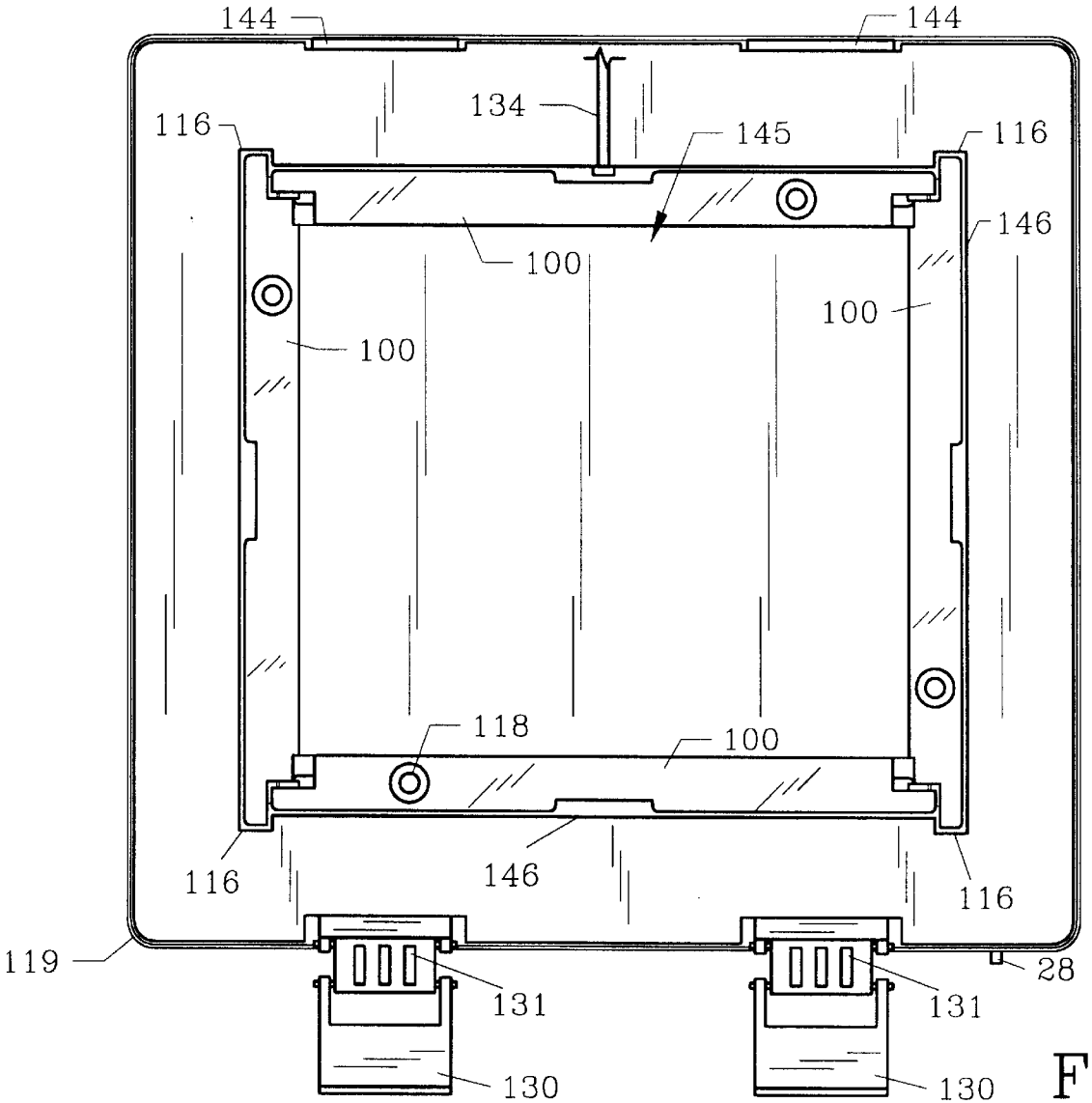
FIG. 14 shows a top down view of the cooling elements disposed within the chest.
Figure 15:
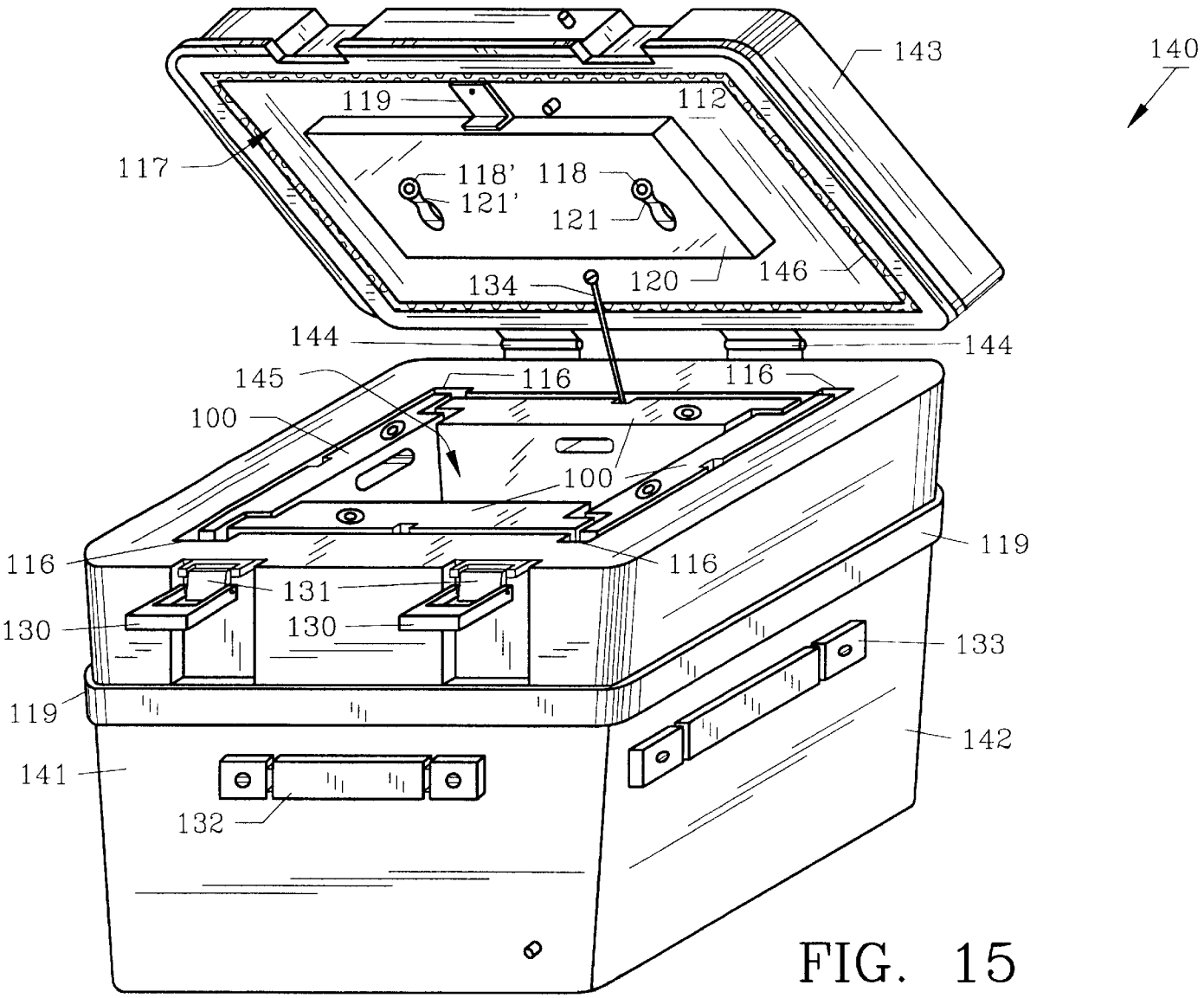
FIG. 15 features a perspective view of the preferred embodiment of the present invention.

In the preferred embodiment of chest 140 shown in FIGS. 14 and 15, side walls 141 and 142 have reinforcing ridges 119 and conventional flip restraining members 130 with combination locks 131 disposed therein. Handles 132, 133 and another handle not shown opposite handle 133 provide means to carry chest 140 in its closed state. Wire restraining member 134 prevents cover 143 from damaging hinges 144 from overzealous openings. While steel wire is preferred, other flexible members could be used.

After selecting the appropriate thermal element, whether it be thermal element 60 or an arrangement of cooling elements 100, and placing them in container 12 of chest 10 or preferred chest 140, to complete the preferred method of using the chest, the user can then place an item (not shown) such as an ice cream carton in container 12. Cover 11, having resilient gasket 53, is then closed and vacuum pump 50 is attached to conduit 35 after ball valve 36 is rotated by wrench 37 to an open position from the closed position. Vacuum pump 50 is then activated and the interior of container 12 is depressurized to approximately 180–250 mm of Hg. Next, wrench 37 is inserted into channel 39 and ball valve 36 is rotated to a closed position as shown in FIG. 5 which prevents air passage through conduit 35. Pump 50 is then disconnected from conduit 35 and chest 10 is pneumatically sealed and ready for transportation. It has been found that chest 10 will maintain a −20° C. temperature for approximately twenty-four hours when closed as described with outside temperatures of approximately 25° C. This temperature-controlled environment will allow the user to store and transport ice-cream or other perishable foods or other products over long distances as may be necessary in the food, medical, or biological trades. Likewise, items may be heated for extended periods of time because chest 10 does not lose heat as other conventional heat retaining means do. Chest 140 has a gasket, conduits, valves and a wrench channel identical to those described in chest 10, which are indicated in the drawings, but not labeled.

Figure 9:
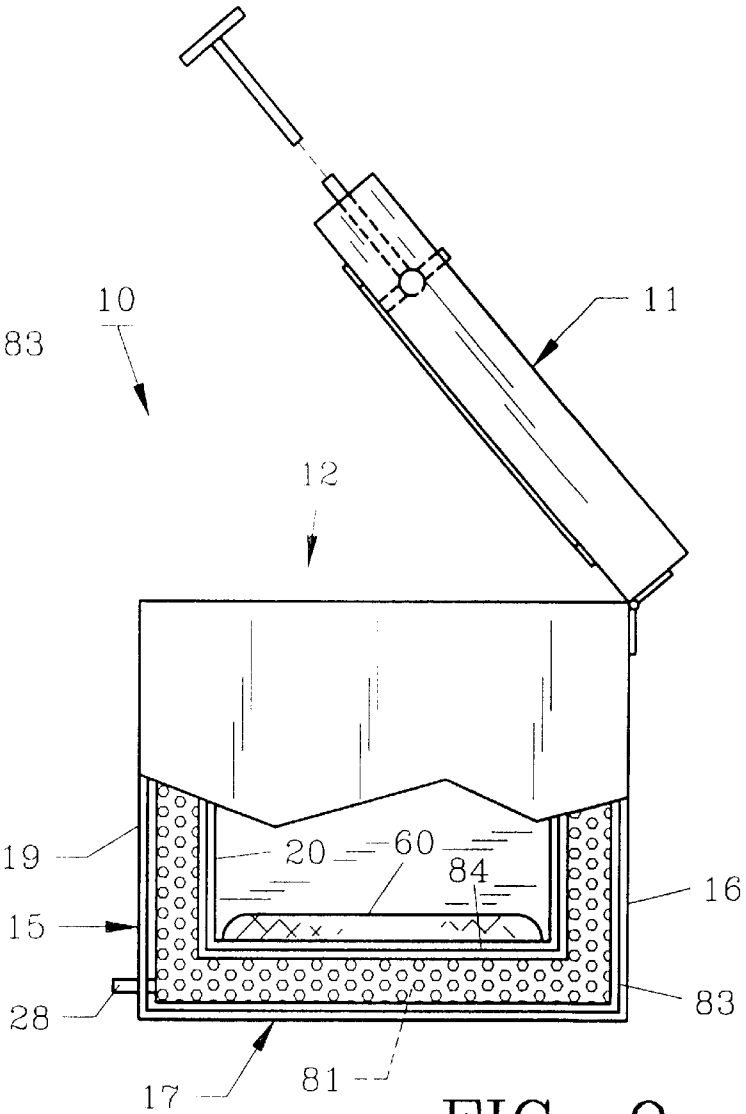
FIG. 9 features a cutaway side view of the chest of FIG. 1 with the bladder disposed within the side walls.
Figure 8:
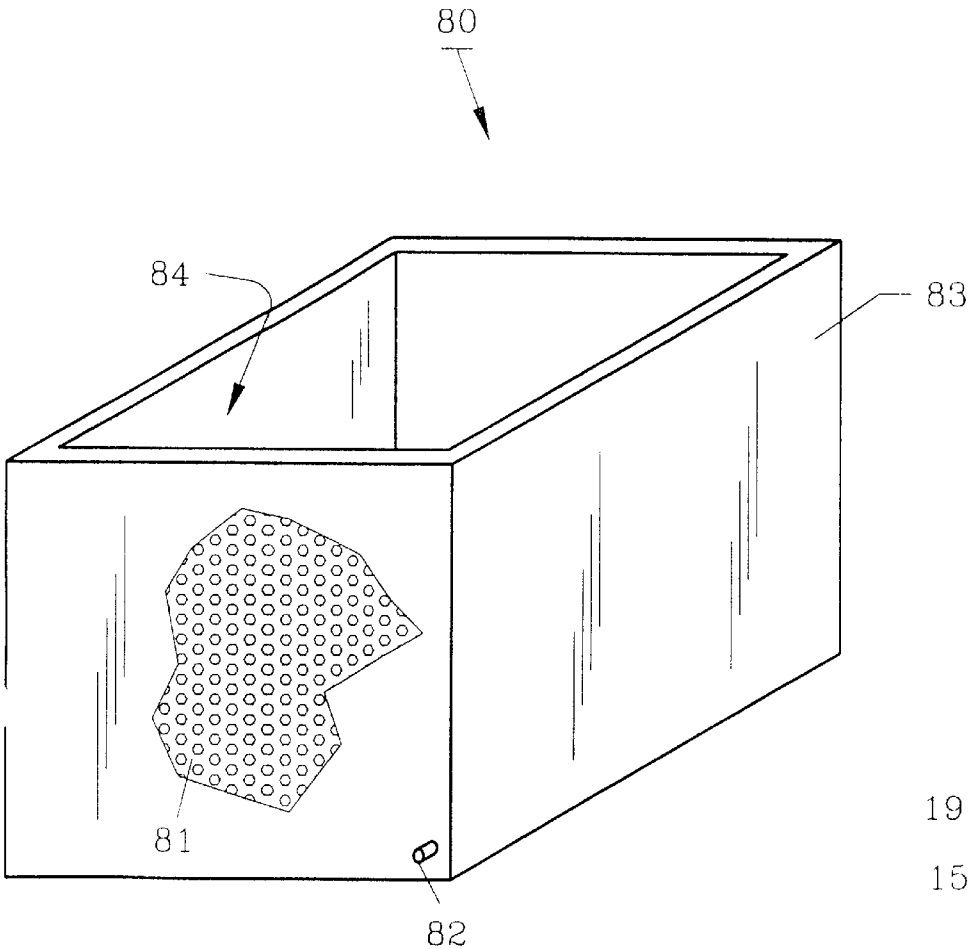
FIG. 8 illustrates a bladder for insertion within the side walls of the chest of FIG. 1.

In an alternate embodiment, shown in FIGS. 8 and 9, instead of a liquid sealing means as described above, a bladder such as shown in FIG. 8 could be used. Bladder 80 has exterior surface 83 and interior surface 84 with conduit 82 passing through exterior surface 83. Bladder 80 is comprised of a non-porous elastomer, but is premolded into a somewhat cup-like shape and filled with insulating material 81 such as polyurethane foam, glass beads or foam beads. The air is then evacuated from within the bladder by conduit 82 by vacuum pump 50 and conduit 82 is closed by conventional means to prevent air flow back into bladder 80. Bladder 80 is placed in chamber 70 between inner wall 20 and outer wall 19.

Again, insulation 81 should be rigid enough to provide support for the side walls when the vacuum is drawn out of chamber 70 by conduit 28. When the vacuum applied inner wall 20 and outer wall 19 will compress against the bladder and form a tight seal thereagainst so that the vacuum is maintained.

FIG. 14 shows a top down view of the preferred embodiment of chest 140. Specifically thermal elements 100 are disposed around the interior walls of container 145. Another thermal element (not shown) can rest on the floor of the chest. Inside wall 146 of chest 140 forming container 145 is sloped inwardly so that thermal elements 100 lean against wall 146. Slots 116 are provided to receive wings 107 and 107' and thereby maintain thermal elements 100 in position.

The illustrations and examples shown and described can be modified and changed by those skilled in the art and such examples and drawings are merely for explanatory purposes and are not intended to limit the scope of the appended claims.

We claim:

1. A cooling element comprising:

a) a housing;

b) a chargeable thermal mass, said thermal mass disposed within said housing; and c) a wing, said wing disposed on said housing for engagement with a second cooling element.

2. The cooling element as claimed in claim 1 wherein the chargeable thermal mass comprises a liquid.

3. The cooling element as claimed in claim 2 wherein said liquid is comprised of a salt solution.

4. The cooling element as claimed in claim 1 further comprising a pair of wings, said wings disposed on opposed ends of said housing.

5. A plurality of cooling elements as claimed in claim 4 wherein said wings interlockingly engage one another to maintain said cooling elements in a desired configuration.

6. The cooling element of claim 1 further comprising means for indicating a charge on said thermal mass, said charge indicating means proximate said thermal mass.

7. The cooling element as claimed in claim 6 wherein said indicating means comprises a color change indicator.

* * * * *